US009404067B2

(12) United States Patent
Batton et al.

(10) Patent No.: US 9,404,067 B2
(45) Date of Patent: Aug. 2, 2016

(54) FLUORO-INORGANICS FOR INHIBITING OR REMOVING SILICA OR METAL SILICATE DEPOSITS

(71) Applicant: Ecolab USA Inc., Eagan, MN (US)

(72) Inventors: Carol B. Batton, Yorkville, IL (US); John E. Hoots, Batavia, IL (US); Anthony G. Sommese, Wheaton, IL (US); Thomas M. Miller, Aurora, IL (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 14/469,323

(22) Filed: Aug. 26, 2014

(65) Prior Publication Data

US 2016/0060576 A1 Mar. 3, 2016

(51) Int. Cl.

| | |
|---|---|
| ***C11D 3/06*** | (2006.01) |
| ***C09K 8/05*** | (2006.01) |
| ***C09K 8/528*** | (2006.01) |
| ***E21B 37/00*** | (2006.01) |
| ***C11D 3/00*** | (2006.01) |
| ***C11D 11/00*** | (2006.01) |
| ***C11D 3/04*** | (2006.01) |
| ***C11D 3/32*** | (2006.01) |
| ***C11D 3/16*** | (2006.01) |

(52) U.S. Cl.

CPC ..... *C11D 3/0026* (2013.01); *C11D 3/04* (2013.01); *C11D 3/06* (2013.01); *C11D 3/162* (2013.01); *C11D 3/323* (2013.01); *C11D 11/0041* (2013.01)

(58) Field of Classification Search

CPC ..... C11D 3/06; C11D 3/245; C11D 3/323; C09K 8/05; C09K 8/528; E21B 37/00

See application file for complete search history.

(56) References Cited

U.S. PATENT DOCUMENTS

| | | | | |
|---|---|---|---|---|
| 8,034,253 | B2 | 10/2011 | Monzyk et al. | |
| 8,389,453 | B2 | 3/2013 | Thomson | |
| 8,796,195 | B2 | 8/2014 | Thomson | |
| 2009/0176689 | A1 | 7/2009 | Thomson | |
| 2009/0233819 | A1 | 9/2009 | Fuller et al. | |
| 2011/0079392 | A1 | 4/2011 | Reyes | |
| 2012/0097392 | A1 | 4/2012 | Reyes et al. | |
| 2012/0325485 | A1 | 12/2012 | Qu et al. | |
| 2013/0178405 | A1* | 7/2013 | Thomson | 510/109 |

FOREIGN PATENT DOCUMENTS

| | | | |
|---|---|---|---|
| WO | 95/16006 | A1 | 6/1995 |
| WO | 01/70922 | A1 | 9/2001 |
| WO | 2009/121893 | A1 | 10/2009 |
| WO | 2012/059714 | A1 | 5/2012 |
| WO | 2014/004697 | A2 | 1/2014 |

OTHER PUBLICATIONS

International Search Report and Written Opinion issued for PCT/US2015/047065, dated Dec. 18, 2015, 13 pages.

* cited by examiner

*Primary Examiner* — Brian P Mruk
(74) *Attorney, Agent, or Firm* — Senniger Powers LLP

(57) ABSTRACT

The present invention generally relates to methods for removing silica or silicate deposits comprising contacting a cleaning composition with a surface in contact with a liquid containing silica or silicates, wherein the cleaning composition comprises a salt of a nitrogen base having a fluoro inorganic anion. In particular, these methods for removing silica or silicate deposits can be used in steam generators, evaporators, heat exchangers, and the like that are used in produced water plant unit operations.

18 Claims, 12 Drawing Sheets

FLUORO-INORGANICS FOR INHIBITING OR REMOVING SILICA OR METAL SILICATE DEPOSITS

FIELD OF THE INVENTION

The present invention generally relates to methods for removing silica or silicate deposits comprising contacting a cleaning composition with a surface in contact with a liquid containing silica or silicates, wherein the cleaning composition comprises a salt of a nitrogen base having a fluoro inorganic anion. In particular, these methods for removing silica or silicate deposits can be used in steam generators, evaporators, heat exchangers, and the like that use water compositions containing produced water and other water sources in plant unit operations.

BACKGROUND OF THE INVENTION

Silicate-based deposits can occur in many industrial systems. For example, silicate-based deposits are a problem in some boilers, evaporators, heat exchangers and cooling coils. The presence of silica/silicate deposits can significantly reduce system thermal efficiency and productivity, increase operating/maintenance costs, and in some cases lead to equipment failure. Steam generators and evaporators are especially prone to silicate deposits due to operation at elevated temperatures, pH and increased cycles of concentration (COC).

In particular, silicate-based deposits are prevalent in produced water (steam assisted gravity drainage (SAGD), steam flood, etc.) plant unit operations. The type and structure of silica deposits can range from amorphous silica to highly complex metal silicates with hardness ions (primarily calcium/magnesium), aluminum, iron/alkali-metal ions (sodium, lithium, etc.). Amorphous silica, iron salts, carbonates, organic-based foulants and other chemicals may be incorporated into deposits.

For example, SAGD operations inject steam into geological formations to stimulate the production of bitumen or heavy hydrocarbon. Oil Sands deposits in Alberta, Canada represent an area where this process is extensively used. Pairs of horizontal wells are bored into the oil-containing formation. The upper well injects steam and the lower well which is positioned below the steam injection line, continuously extracts a complex emulsion. That emulsion contains bitumen and water. The emulsion is broken; the bitumen is sent for upgrading/refining, while the produced water (separated from the emulsion) is treated and reused as feedwater for the steam generators.

This SAGD process for producing bitumen results in large volumes of silica-laden water because oil sand formations contain large proportion of silica/silicate-bearing minerals (sand, clays, etc.) compared to the amount of bitumen present. Oil Sands "typically" consist of about 75% inorganic matter (including a large % of silica/silicates), 10% bitumen, 10% silt/clay and 5% water (Humphries, 2008). Large volumes of silica-laden produced water are returned from the 2-to-9 volumes of steam (cold water equivalent) injected per volume of bitumen recovered (Tristone Capital Inc. (2007). SAGD: Looking Beneath the Surface. Energy Investment Research, 4-5). Concentrations of silica returning to SAGD plant in the produced water tend to range from about 11-350 mg/L (Goodman, W., Godfrey M., Miller, T. (2010). Scale and Deposit Formation in Steam Assisted Gravity Drainage (SAGD) Facilities, *International Water Conference in San Antonio, Tex.*, October 24-28, IWC-10-19).

There are two options for treating the returned produced water and supplemental makeup water for use as feedwater for steam generation. The first option is warm lime softening (WLS) and is the more traditional method for treating produced water. For silica reduction WLS is used followed with a weak acid cation (WAC) ion exchange for hardness removal. The treated water quality is poor relative to ABMA/ASME boiler feedwater standard guidelines. However, the use of Once-through steam generators (OTSG) mitigates the need for high purity water. In a preferred operation mode of the OTSG, the feedwater can have less than 8000 mg/L total dissolved solids (TDS) and near zero total hardness and the Silica ($SiO_2$) specification is typically less than 50 mg/L. The WLS/Ion exchange process can achieve these requirements.

Evaporation technology (in particular mechanical vapor compression (MVC)) is the second and newer option of water treatment. The main reason for using evaporators to treat produced water is to achieve a very high quality of water so a conventional drum boiler can be used instead of OTSG. However, in some cases, evaporators are used to clean extremely dirty produced water along with other waste streams for use as feedwater in OTSG. As the industry looks to more and more recycled water, evaporators will play an important role in treating waste water for reuse. This can be accomplished because the evaporation technology is more robust and can be used on the more difficult to treat waste waters.

With evaporators, a high percentage of produced water is recovered as high quality boiler feedwater. High quality feedwater produced from evaporation enhances reliability of the steam generation equipment. The evaporator footprint is also significantly smaller than conventional WLS treatment.

Because of the nature of the water being treated, evaporators are likewise subject to deposition. Chemical treatment programs are used to minimize deposits, but evaporators can become fouled over time and cleaning is in order. Options for cleaning are chemical in-situ programs or mechanical.

As a result of significant silica/silicate deposit formation that can occur in unit operations such as evaporators, opportunities exist to improve system operations by using an effective in-situ chemical cleaning program. One option to deal with declining performance of Mechanical Vapor Compression (MVC) evaporators or evaporators in general due to scale deposits is to implement a chemical wash. Chemistries previously used are commodity acid or caustic which usually are not fully effective for dissolving silicate deposits. Those cleaners can be very hazardous to both equipment and personnel. If a chemical wash does not effectively dissolve tenacious deposits, then mechanical cleaning is performed. Mechanical cleaning is useful for removing flaky deposits but may only polish a more tenacious deposit without removing it and leading to a continued deposition of layers over time. Mechanical cleaning is very time consuming, expensive (e.g., for waste removal/labor costs), and can result in significant lost production. Thus, a need exists for a safe, novel chemistry used for evaporator washes to remove silica/silicate and organic-based deposits.

SUMMARY OF THE INVENTION

One aspect of the invention is a method for removing a silica or a silicate deposit or for inhibiting silica or silicate deposition comprising contacting a cleaning composition with a surface. The surface is in contact with a liquid containing a silica or a silicate and having a silica or a silicate deposit or being susceptible to forming a silica or a silicate deposit. The cleaning composition comprises an antifoaming agent and a salt of a nitrogen base having a fluoro inorganic anion.

Another aspect is a cleaning composition comprises an antifoaming agent and a salt of a nitrogen base having a fluoro inorganic anion.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
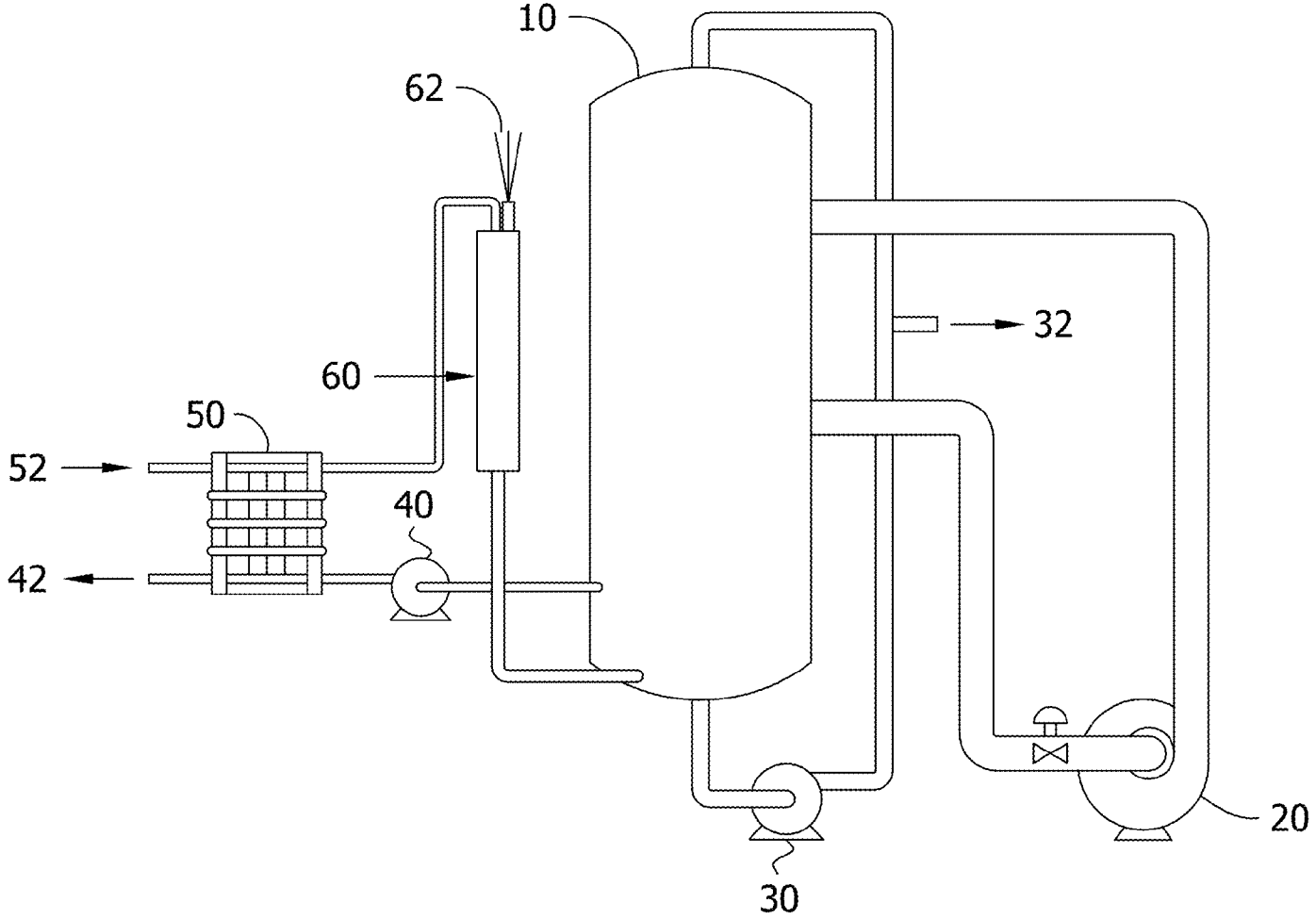
FIG. 1 is a schematic of an evaporator system based on MVC operation.

The present invention is directed to methods for removing silica or silicate deposits. The cleaning compositions of the invention provide more effective cleaning of deposits, quicker turnaround for equipment, and reduce the need to mechanically clean the affected surfaces of the industrial system. In addition, the cleaning compositions are less hazardous than many alternative cleaning agents. Further, the cleaning compositions are particularly effective for cleaning boilers, steam generators, and evaporators. For example, the cleaning compositions are useful for cleaning boilers, steam generators, and evaporators that are used to process produced water (SAGD, steam flood, etc.).

One aspect of the present invention is directed to a method for removing silica or silicate deposits comprising contacting a cleaning composition with a surface the surface having or being susceptible to forming silica or silicate deposits from contact with a liquid containing silica or silicates, wherein the cleaning composition comprises a salt of a nitrogen base having a fluoro inorganic anion. The cleaning composition can further comprise an antifoaming agent.

Another aspect of the invention is a cleaning composition comprising an antifoaming agent and a salt of a nitrogen base having a fluoro inorganic anion.

The fluoro inorganic anion can comprise tetrafluoroborate, hexafluorophosphate, or a combination thereof. Additionally, the hydrolysis products of tetrafluoroborate and hexafluorophosphate that contain fluorine atoms can also be used.

Preferably, the fluoro inorganic anion of the cleaning composition comprises tetrafluoroborate.

The cleaning compositions can have the fluoro inorganic anion comprise tetrafluoroborate and the nitrogen base comprise urea and the molar ratio of urea to tetrafluoroboric acid used to prepare the salt is 1:3 to 5:1, preferably 1:2 to 3:1. The nitrogen base (e.g., urea) can react with the fluoro inorganic acid (e.g., fluoroboric acid) to form the salt of a nitrogen base having a fluoro inorganic anion (e.g., urea tetrafluoroborate). However, the relative amounts and/or concentrations of the fluoro inorganic acid component and base component in the compositions of the present invention can vary widely, depending on the desired function of the composition and/or the required cleaning activity. As such, the weight ratios and/or concentrations utilized can be selected to achieve a composition and/or system having the desired cleaning and health and safety characteristics.

The nitrogen base can be urea, biuret, an alkyl urea, an alkanolamine, an alkylamine, a dialkylamine, a trialkylamine, an alkyltetramine, a polyamine, an acrylamide, a polyacrylamide, a vinyl pyrollidone, a polyvinyl pyrollidone, or a combination thereof.

The salt of a nitrogen base having a fluoro inorganic anion is disclosed in U.S. Pat. Nos. 8,389,453 and 8,796,195 and available commercially from Nalco-Champion as Product No. EC6697A.

The antifoaming agent of the cleaning composition can comprise a nonionic silicone (available commercially from Nalco, Inc. as Product No. 336FG), an ethoxylated, propoxylated $C_{14}$-$C_{18}$ alcohol (available commercially from Nalco, Inc. as Product No. 00PG-007), nonionic alkoxylated $C_6$-$C_{10}$ alcohol comprising both ethoxy and propoxy groups (available commercially from Nalco, Inc. as Product No. R-50360), nonionic propylene glycol, ethylene glycol block copolymer (available commercially from Nalco, Inc. as Product No. PP10-3038), an ethoxylated $C_{11}$-$C_{14}$ alcohol (available commercially from Nalco, Inc. as Product No. PP10-3148), a propylene oxide glycol polymer (available commercially from Nalco, Inc. as Product No. 7906), a $C_{16}$-$C_{18}$ alcohol (available commercially from Nalco, Inc. as Product No. 7465), or a combination thereof.

Preferably, the antifoaming agent of the cleaning composition comprises a nonionic silicone commercially available from Nalco, Inc. as Product No. 336FG.

The antifoaming agent can be present in the cleaning composition at a concentration of from about 1 mg/L to about 50,000 mg/L, from about 1 mg/L to about 40,000 mg/L, from about 1 mg/L to about 30,000 mg/L, from about 1 mg/L to about 20,000 mg/L, from about 1 mg/L to about 10,000 mg/L, from about 5 mg/L to about 10,000 mg/L, from about 5 mg/L to about 5,000 mg/L, from about 5 mg/L to about 1,000 mg/L, from about 5 mg/L to about 500 mg/L, from about 5 mg/L to about 300 mg/L, from about 5 mg/L to about 200 mg/L, from about 10 mg/L to about 10,000 mg/L, from about 10 mg/L to about 5,000 mg/L, from about 10 mg/L to about 1,000 mg/L, from about 10 mg/L to about 500 mg/L, from about 10 mg/L to about 300 mg/L, from about 10 mg/L to about 200 mg/L, from about 50 mg/L to about 5,000 mg/L, from about 50 mg/L to about 1,000 mg/L, from about 50 mg/L to about 500 mg/L, from about 50 mg/L to about 250 mg/L or from about 50 mg/L to about 150 mg/L.

The antifoaming agent is effective at the low pH and very high conductivity of the cleaning compositions, as well as in cleaning solutions containing hardness ions, silica, organics, or heavy metals (e.g., iron) removed from fouled surfaces.

The cleaning composition can also include a corrosion inhibitor. The corrosion inhibitor employed in the present invention can be any one or more corrosion inhibitors known to those skilled in the art and/or specifically dictated by several factors including, but not limited to, the type of surface to be treated (metals, such as, aluminum, steel, iron, brass, copper, ceramics, plastics, glass etc.), the tetrafluoroboric acid concentrations thereof included in the system, system pH, the inhibitor efficiency, inhibitor solubility characteristics, desired length of exposure of the system to the surface, environmental factors, etc. Accordingly, such a corrosion inhibitor can be a sulfonate, a carboxylate, an amine, an amide, a borated-based inhibitor compound, or a combination thereof.

The cleaning compositions can optionally comprise one or more nonionic, anionic, cationic or amphoteric surfactants or a mixture thereof to improve both performance and economy. The type of surfactant selected can vary, for example, depending on the nature of the particular conditions of use (e.g., type of residue to be removed or type of surface), and/or the nature of the solvent (e.g., aqueous versus a less polar solvent such as an alcohol or other organic solvent).

Preferably, the cleaning composition can comprise a nonionic surfactant. The nonionic surfactant can be Videt Q3™ surfactant, which demonstrates rapid wetting due to the excellent, associated dynamic surface tension profile and is commercially available from Vitech International, Inc.).

The cleaning composition can further comprise an organic inhibitor of silica or silicate deposition.

The inorganic or organic inhibitor of silica or silicate deposition can be boric acid, borates, oligomeric and polymeric compounds (e.g., acrylic acid-polyethylene glycol monomethacrylate copolymer (Product No. 3DT155 available from Nalco) and 2-propenic acid, polymer with a 2-propenyl-w-hydroxypoly(oxy-1,2-ethanediyl), sodium salt (Product No. 3DT156 available from Nalco).

The compositions of the present invention can be provided in conjunction with a fluid or an aqueous medium and can be provided in a ready-to-use form or can be provided as separate agents and the composition can be prepared at the site of the treatment. Depending on the nature of use and application, the composition can be in form of a concentrate containing a higher proportion the salt of nitrogen base having a fluoro inorganic anion, the concentrate being diluted with water or another solvent or liquid medium or other components such as the antifoaming agent, organic inhibitor of silica or silicate deposits, corrosion inhibitor, or surfactant before or during use. Such concentrates can be formulated to withstand storage for prolonged periods and then diluted with water in order to form preparations which remain homogeneous for a sufficient time to enable them to be applied by conventional methods. After dilution, such preparations may contain varying amounts of the cleaning composition, depending upon the intended purpose or end-use application.

Preferably, the surface that is in contact with the cleaning composition is an internal surface of a piece of equipment. This piece of equipment could be a boiler, a steam generator, an evaporator, a heat exchanger, a cooling coil, a tank, a sump, a containment vessel, a pump, a distributor plate, or a tube bundle The piece of equipment whose internal surface is cleaned in the method described herein could also be a pipe, a drain line, a fluid transfer line, a production well, or a subterranean hydrocarbon containing reservoir.

Preferably, the piece of equipment cleaned using the methods described herein is an evaporator used in a steam-assisted gravity drainage system.

The method for cleaning the surface in contact with a liquid containing silica or silicates can be performed at a temperature from about 0° C. to about 374° C., from about 20° C. to about 320° C., or from about 40° C. to about 100° C.

For an evaporator, the method can be performed at a temperature from about 20° C. to about 100° C., from about 40° C. to about 100° C., from about 40° C. to about 90° C., from about 40° C. to about 80° C., or from about 60° C. to about 80° C.

For a boiler, the method is performed at a temperature from about 40° C. to about 340° C., from about 250° C. to about 330° C., or from about 300° C. to about 330° C., from about 310° C. to about 320° C., or from about 40° C. to about 100° C.

When the system to be cleaned is off line for cleaning, the method for cleaning the surface in contact with a liquid containing a silica or a silicate can be performed using a cleaning composition having a concentration of from about 1 v/v % to about 50 v/v %, from about 3 v/v % to about 25 v/v %, from about 10 v/v % to about 20 v/v %, or about 15 v/v % of the composition containing the salt of the nitrogen base having a fluoro inorganic anion based on the total weight of the cleaning composition.

Further, when the system is off line for cleaning, the method for cleaning the surface in contact with a liquid containing silica or silicates can be performed using a cleaning composition having a concentration of from about 1 v/v % to about 50 v/v %, from about 3 v/v % to about 25 v/v %, from about 10 v/v % to about 20 v/v %, or about 15 v/v % of Product No. EC6697A (available from Nalco-Champion) based on the total weight of the cleaning composition.

When the system is on-line and a cleaning process using the cleaning composition is used, the concentration of the cleaning composition in the feedwater is from about 5 mg/L to about 300 mg/L, from about 30 mg/L to about 300 mg/L, or from about 30 mg/L to about 100 mg/L. Preferably, when the system is on-line and a cleaning process using the cleaning composition is used, the concentration of the cleaning composition in the feedwater is from about 30 mg/L to about 100 mg/L.

The method for removing a silica or a silicate deposit can also remove organic deposits. The organic deposits that can be removed from the surface can water-soluble organics, bitumen, naphthenic acids, and organics which may be partially thermally degraded.

In particular, the application site for use of the cleaning composition can be four two-stage evaporators running in parallel. The evaporators operate based on the MVC principle. The primary and secondary stages of each evaporator operate in series and are housed within the same containment vessel. One evaporator is larger than the other three evaporators.

FIG. 1 shows the major components in an evaporator system. A vapor compression evaporator (or brine concentrator)

10 can contain various internal structures including tube bundles and brine distributors. The vapor compression evaporator 10 is connected to a compressor 20, a recirculation pump 30, a deaerator 60 having a vent 62, and a distillate pump 40. Wastewater 52 is fed through a heat exchanger 50 into the deaerator 60 and into the vapor compression evaporator 10. The distillate 42 exits the vapor compression evaporator 10 into a distillate pump 40 and through the heat exchanger 50. The brine is recirculated through the recirculation pump 30 and waste brine exits the waste brine line 32. Steam is compressed by circulating through the compressor 20.

The typical operating characteristics for an evaporator system like the one shown in FIG. 1 are detailed in Table 1.

TABLE 1

Typical Operating Characteristics (approx.)

| Parameter | Smaller System | Larger System |
|---|---|---|
| Feedwater Flow (m3/hr) | 250 | 300 |
| Tube Bundle Surface Area ($m^2$) | 12,000 | 12,000 |
| Feedwater Temp. (° C.) | 80 | 80 |
| Sump Temp. (° C.) | 105 | 105 |
| Total Distillate (m3/hr) | 244-245 | 293-294 |
| Blowdown Rate (m3/hr) | ~5-6 | ~6-7 |
| Total Cycles of Concentration (target) | 45-55 | 45-55 |

Falling film MVC evaporators have high heat transfer characteristics and efficiency compared to other evaporator designs (Heins, W. (2008). Technical Advancements in SAGD Evaporative Produced Water Treatment, *International Water Conference in San Antonio, Tex.*, October 26-30, IWC-08-55). A high heat transfer coefficient is required to effectively evaporate the water and increase the temperature (ΔT ~27° C. at application site) to produce high quality feedwater. Along with the evaporative process, the concentration of substances present in the feedwater can be cycled up as high as 45-55 times their initial concentration. The combination of higher temperature and higher concentrations of inorganic and organic substances increases the probability that the inversely soluble and particulate substances will deposit on wetted portions of evaporator system.

Thus, clean heat-transfer surfaces are very desirable for energy-efficient production of distillate from water that contains high levels of inorganic salts and organic contaminants. When deposits form insulating layers on heat-exchanger surfaces of evaporators, a reduction in U-values (heat-transfer coefficient) occurs. While operating conditions of the evaporator can be adjusted within limits to compensate for the decrease in U-values, low U-values at some point lead to reduction of distillate flow rate and de-rating of the evaporator operation. If insufficient distillate is available for plant operation (feed water for OTSGs and heat recovery steam generators (HRSGs)), then bitumen production can be reduced.

In addition to reducing evaporator heat-transfer efficiency and corresponding production of distillate, deposits can block heat-transfer tubes, distribution plates, and flow channels. System blockages can lead to poor distribution of water, further reduction in distillate production and make cleaning the system, even with mechanical means, very difficult, costly, labor-intensive, and time-consuming.

In thermal-recovery of bitumen operations, complex mixtures of waters (e.g., produced water, various recycled water streams, and brackish water) are combined to form evaporator feedwater. The ratios of the various water streams and their chemical compositions can vary greatly over time. Further, the drive to maximize efficiency of water usage and reduce water discharge via the increased level of water recycling can lead to increasing levels of deposit-forming ions and substances over time. This is sufficient to impede evaporator operation.

The average evaporator feedwater quality for five months of operation and the impact of operating at total cycles of concentration of 45 are shown in Table 2. The inorganic portion of water chemistry was measured by inductively-coupled plasma (ICP) spectroscopy.

TABLE 2

Evaporator Feedwater Quality and Impact of Cycles of Concentration

| | Concentration (mg/L) | |
|---|---|---|
| Chemistry* | Feedwater | @ 45 cycles** |
| Aluminum (as Al) | 0.23 | 10.4 |
| Calcium (as Ca) | 2.24 | 101 |
| Magnesium (as Mg) | 0.58 | 26.1 |
| Ca + Mg Hardness (as $CaCO_3$) | 8.0 | 360 |
| Silica (as $SiO_2$) | 244 | 10,980 |
| TOC | 760 | 34,200 |

*Additional ions at high concentrations in the feedwater are boron ~29 mg/L, $Na^+$ ~690 mg/L, $Cl^-$ ~210 mg/L, and sulfate ~280 mg/L
**Assumes 100% Transport, deposit formation will result in lower concentrations measured in evaporator blowdown.

Even though evaporator systems are operated at relatively high pH (e.g., feedwater pH is about 10.6, primary system pH is about 12.0, and secondary system is about 12.3), the combination of aluminum, hardness, and silica ions shown in Table 2 can and did result in a deposit forming over time. Due to the large volume of feedwater (e.g., 250-300 $m^3$/hour target rate per evaporator) passing through the system, every mg/L of inorganic or organic material that is deposited from feedwater corresponds to 250-300 grams/hour or 2.2-2.6 metric tons/year deposited in each evaporator.

Due to water recycling and the need to maximize water usage, levels of deposit-forming inorganic ions and organics in feedwater increased over time.

When hydroblasting is used to remove internal deposits, the evaporator system is taken off-line, and cooled and drained of internal aqueous fluid. An entry hatch is opened and personnel/equipment for hydroblasting taken in to the evaporator system. Using a high-pressure water wash lance (hydroblasting), high-pressure water is used to remove deposits and scour the internal surfaces. The deposits removed from the internal surfaces are collected and taken out of the system for disposal. A longer high-pressure water lance is used to remove deposits from on the inside (e.g., tube-side) of long tubes in the heat-exchanger (or tube bundle) portion of the evaporator. After the evaporator is cleaned, the entry port of the system is sealed up and feedwater is added to reach a normal operating level within the system. The water recirculation pumps are started and steam is typically added to the shell-side of heat-exchanger to heat the recirculating water. The mechanical vapor compression pump is started and the system is placed back on-line.

For the method described herein, the evaporator system is taken off-line, drained of internal aqueous fluids and allowed to partially cool to an operating range from 0° C. to 60° C., preferably, 40° C. to 60° C. A distillate or relatively clean water (e.g., utility water) is used to rinse the system by partially filling the evaporator system. Water pumps are used to recirculate the rinse water inside the evaporator to help remove residual amounts of water that may contain high levels of deposit-forming substances (e.g., silica, hardness ions, aluminum, iron, and the like). The water recirculation pumps are stopped and the rinse water is drained from the evaporator. The system is then partially filled with distillate or relatively clean water and circulated using the recirculation water pumps. A sample of the recirculating water is chemically tested to ensure any application guidelines for water quality are met. The temperature of recirculating water is measured to ensure that it is in the operating range.

The volume of water in the evaporator system is measured using a water level monitor in order to determine how much concentrated cleaning solution should be added to reach desired concentration of cleaning solution (e.g., if water volume inside of evaporator is 85 $m^3$, then 15 $m^3$ of concentrated cleaning solution would typically be added to produce a 15 v/v % concentration of cleaning solution). Also, an antifoam agent is added to ensure that foaming within evaporator is minimized (e.g., 4 liters of antifoam product into 100 $m_3$ or 100,000 liters of 15 v/v % cleaning solution would produce about 40 mg/L concentration of antifoam product). Depending on prior experience, more or less antifoam can be added to the cleaning solution. Additional antifoam is injected into the cleaning solution if an unacceptable level of foaming persists. The concentration of the cleaning solution is monitored by an acidity titration method to ensure that the target level of cleaning solution is maintained. If the cleaning solution concentration is too high, then additional water can be added to the evaporator system. If the concentration of the cleaning solution is too low, then additional concentrated cleaning solution can be added. Samples of recirculating cleaning solution are taken at prescribed intervals and water chemistry is measured by colorimetric analysis, acidity titration, pH, and ICP (inductively-coupled plasma) to determine the progress of cleaning process and to ensure that the concentration of the cleaning solution is being maintained within the desired operating limits.

The temperature, and water level are also measured to ensure that system is operating within required limits. The system readings are checked to see if evidence of foaming is occurring. If an operating limit is reached (e.g., temperature of recirculating cleaning solution reaches recommended maximum limit), then the cleaning solution or system operating conditions are adjusted (e.g., additional dilution water is added to cool the recirculating cleaning solution and additional concentrated cleaning solution is added to maintain the concentration of cleaning solution). Chemical analyses of samples of recirculating cleaning solution are used to determine when the cleaning process is completed (e.g., levels of deposit-forming ions such silica, hardness ions, aluminum and the like reach a substantially constant level indicating that the cleaning process is complete) and that any corrosion of the internal surfaces of the evaporator by the cleaning solution is below the desired operating limits.

Then, the evaporator recirculation water pump is stopped and the cleaning solution is drained from the system. Additional rinse water can be added, recirculated and drained as needed to remove residual amounts of cleaning solution remaining in the system. The evaporator is then filled with feedwater to reach a normal operating level within the system. The water recirculation pumps are started and steam is typically added to the shell-side of heat-exchanger to heat the recirculating water, the mechanical vapor compression pump is started, and the system is placed back on-line.

The used cleaning solution drained from the system is disposed. The disposal method can vary based on the application site. One disposal method is to neutralize the cleaning solution with concentrated caustic until an approximately neutral pH is reached. The neutralized cleaning solution can be disposed of by sending it to an off-site disposal facility. Another disposal method is to mix the used cleaning solution with other water streams, neutralize the mixture to precipitate silica, hardness ions, and other deposit-forming substances, filter the precipitated solids (which are disposed), and then dispose of the liquid filtrate by injection into deep-well disposal sites. The number and sequence of steps required in the cleaning of the evaporator and the disposal of used cleaning solution can vary depending on the application site and system design.

Having described the invention in detail, it will be apparent that modifications and variations are possible without departing from the scope of the invention defined in the appended claims.

EXAMPLES

The following non-limiting examples are provided to further illustrate the present invention.

Example 1

Deposit Composition

The chemical composition of four deposits was determined by a standard composition analysis of X-ray fluorescence for elemental composition, organics concentration by C/H/N/S elemental analysis, and the concentrations of organics/water of hydration and other volatile substances by heating to 925° C. for defined period of time. The results are in Table 3.

TABLE 3

| Chemistry | Deposit #1 | Deposit #2 | Deposit #3 | Deposit #4 |
|---|---|---|---|---|
| Silica (as $SiO_2$) | 56% | 49% | 56% | 51% |
| Calcium (as CaO) | 15% | 41% | 11% | 5% |
| Sodium (as $Na_2O$) | 4% | 5% | 7% | 3% |
| Aluminum ($Al_2O_3$) | <0.5% | <0.5% | 1% | 3% |
| Chlorine (as Cl) | 3% | <0.5% | 2% | not detected |
| Magnesium (as MgO) | 2% | 1% | 1% | 8% |
| Potassium ($K_2O$) | <0.5% | <0.5% | 4% | 2% |
| Sulfur (as $SO_3$) | <0.5% | <0.5% | <0.5% | 2% |
| Iron (as $Fe_2O_3$) | <0.5% | <0.5% | 1% | <0.5% |
| Organics | <0.5% | <0.5% | 5% | 14% |
| Loss at 925° C.* | 20% | 2% | 17% | 25% |
| Application -> | Evaporator | Once-Thru HRSG | Evaporator | Evaporator |

*Likely due to water of hydration and also includes organics

Example 2

Lab Scale Tests

The cleaning composition used in these tests was a 15 v/v % of Nalco-Champion as Product No. EC6697A in water.

Figure 2:
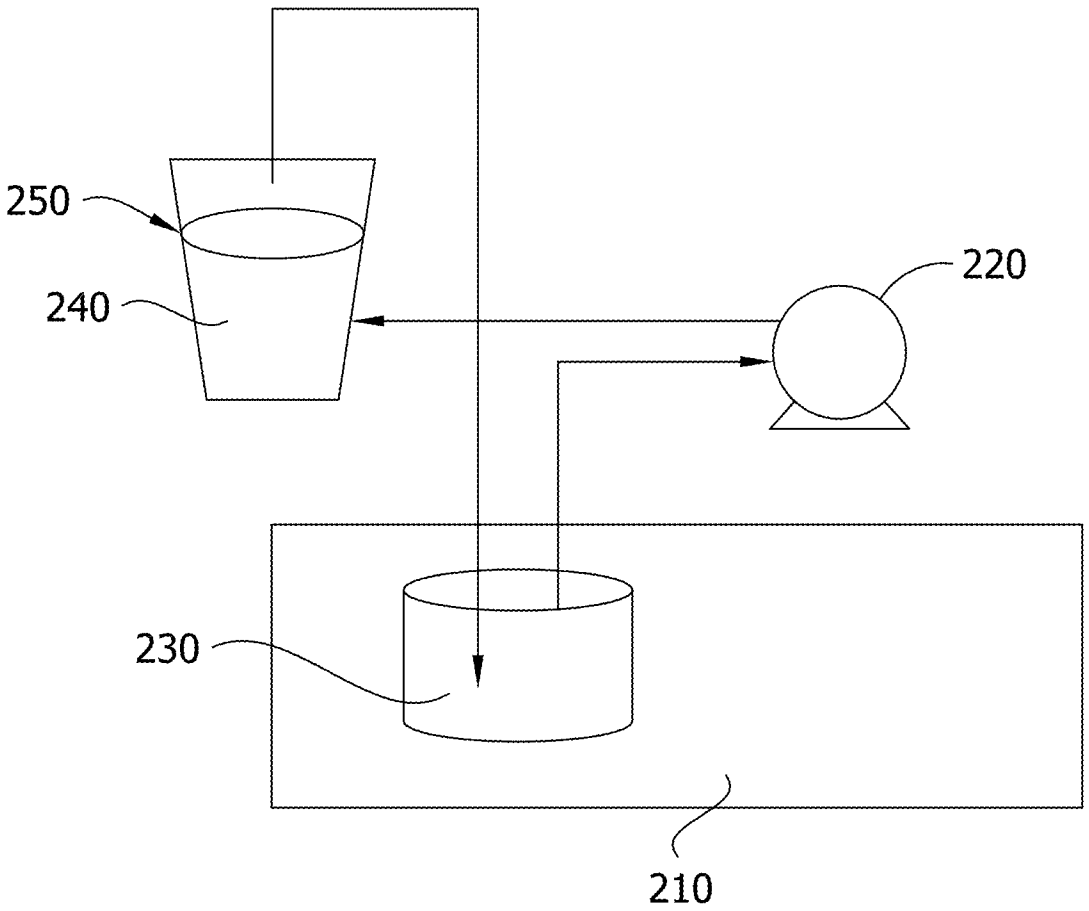
FIG. 2 is a schematic of the dynamic laboratory test apparatus.

A simple laboratory bench unit was designed and built to evaluate new cleaning chemistries under dynamic conditions. This laboratory bench unit is represented by FIG. 2. The deposit 250 for testing was placed in a testing reservoir 240 that was in fluid connection with the cleaning solution reservoir 230. The cleaning solution reservoir 230 is placed in a temperature controlled water bath 210. The cleaning solution can be pumped through a pump 220 from the cleaning solution reservoir 230 to the testing reservoir 240.

The testing apparatus evaluated various cleaning chemistries to obtain data with respect to performance and possible cleaning methods (including temperature, concentration, and time). Additionally, programs and recommendations can be developed for specific deposits. The results translated to improved field performance. FIG. 2 is a schematic of the laboratory scale dynamic test apparatus.

The test method consisted of holding the cleaning solution at a constant temperature while recirculating the cleaning composition across a field deposit sample. The field samples used for the experiment were analyzed for composition and then dried at 105° C. Initial sample weight was taken on the dried, as-received deposit. The deposit sample or object with deposit adhering to it was immersed in flowing cleaning solution for the prescribed test period. The cleaning solution could be heated with test temperatures of 60° C. or 80° C. typically used. The entire container for deposit sample could also be immersed in the heating bath. When the test was completed, the remaining deposit was rinsed with deionized water and blotted dry. The recovered residual deposit was then dried at 105° C. The final weight of the dried deposit was taken and used to determine % dissolution. Aliquots of test solution could be removed during the test to evaluate ion concentrations using ICP spectroscopy and measure treatment performance as cleaning progresses. This procedure allowed for multiple cleanings, varying temperatures and times.

Figure 4A:
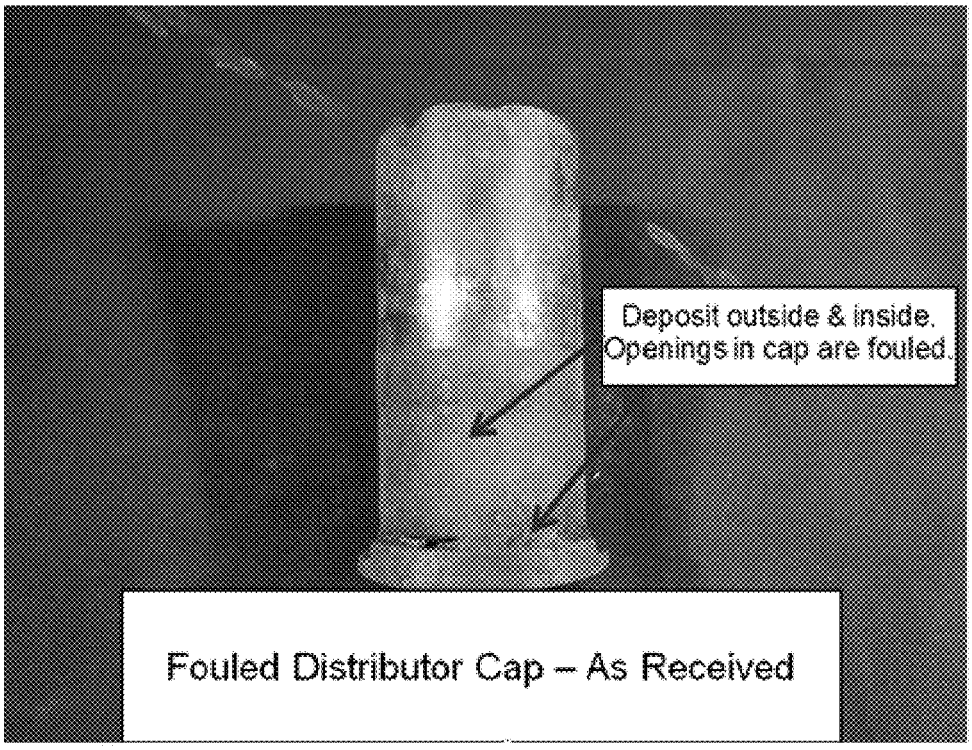
FIGS. 4A and 4B are pictures of a fouled distributor cap and the same distributor cap cleaned with the cleaning composition, respectively.
Figure 4B:
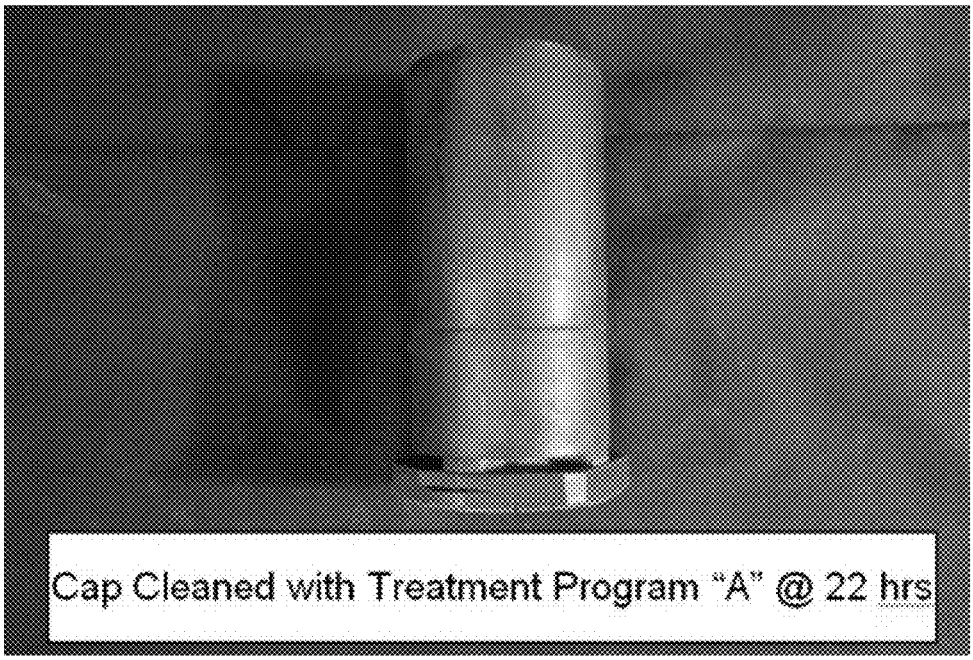

In the situation where a larger object (e.g., water distributor cap) with deposit on it needed to be tested, the sample container was enlarged to allow the entire specimen to be immersed in the recirculating cleaning solution. FIGS. 4A and 4B (before and after pictures) of the evaporator water distributor cap showed exceptional cleaning ability of the cleaning composition. No mechanical cleaning was used on distributor cap.

Figure 5:
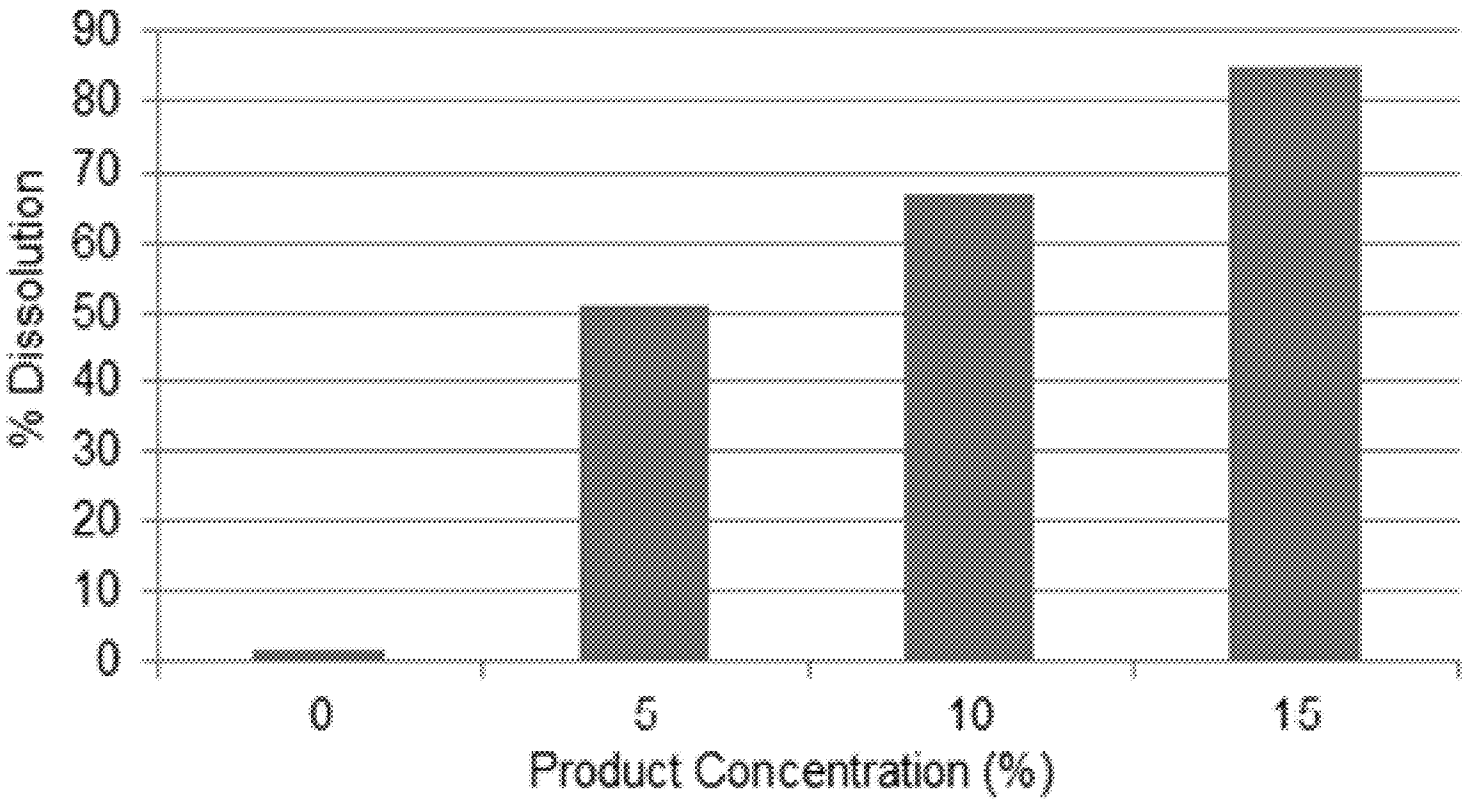
FIG. 5 is a graph of the % dissolution of a deposit versus the cleaning composition concentration in v/v % tested in a laboratory scale experiment described in Example 2.

Lab studies to measure dissolution of metal silicate and organic-based evaporator deposits from application site were conducted. FIG. 5 showed that deposit dissolution results were strongly dependent upon the concentration of cleaning solution (0-15 v/v %). Very good results of 85% dissolution of deposit removal occurred with 15 v/v % concentration of the cleaning composition were obtained at 60° C. after 22 hours.

Figure 6:
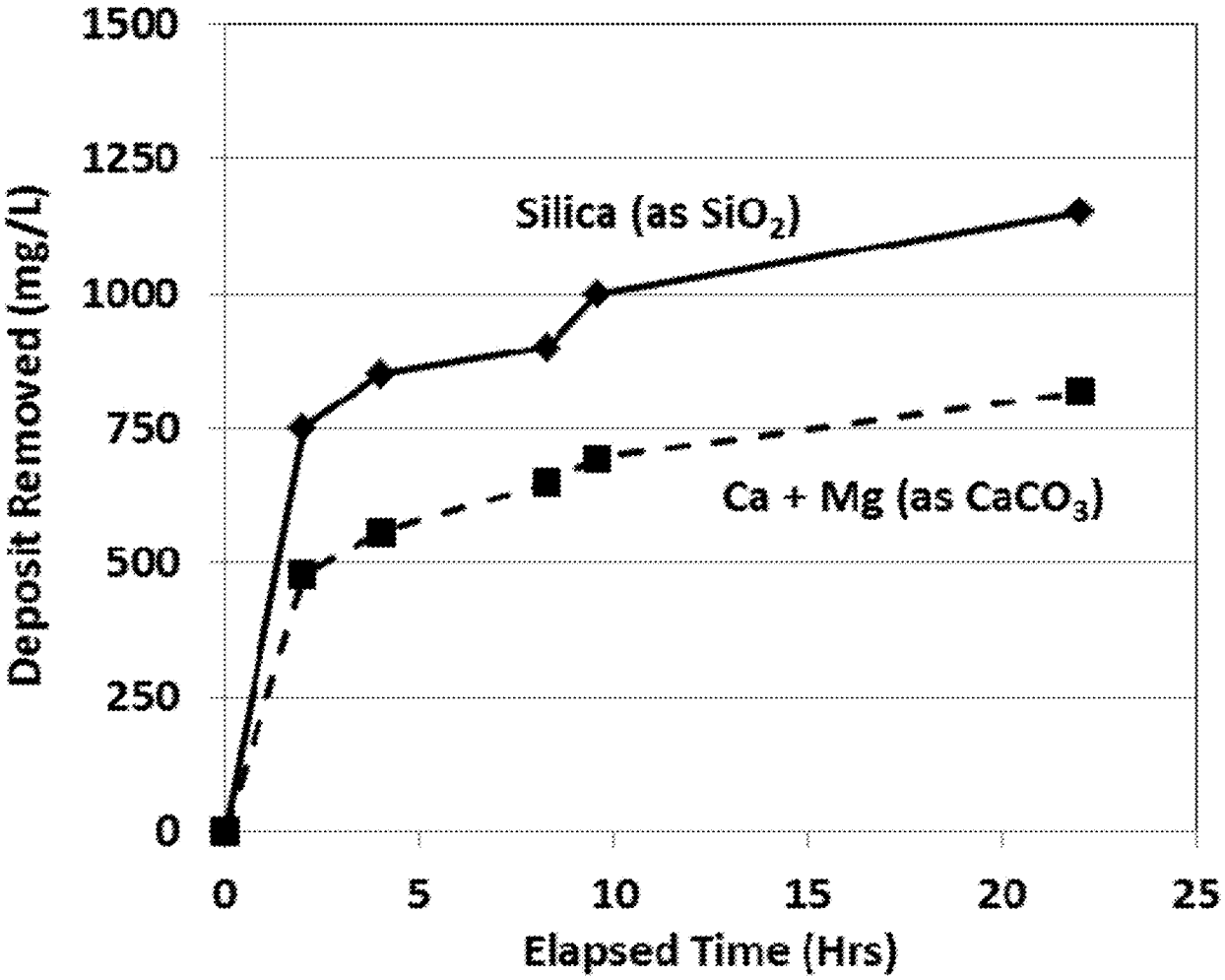
FIG. 6 is a graph of the amount of silica and calcium deposit removed in mg/L versus the elapsed time of the cleaning process with the cleaning composition in hours tested in a laboratory scale experiment described in Example 2.

FIG. 6 showed that hardness ions and silica were rapidly released from an evaporator deposit sample on the water distributor cap during the first five to ten hours of treatment at 60° C. This rapid deposit dissolution period was followed by a lower dissolution rate from 10 to 22 hours as almost all of deposit was dissolved and more resistant portions of deposit were attacked.

Figure 7:
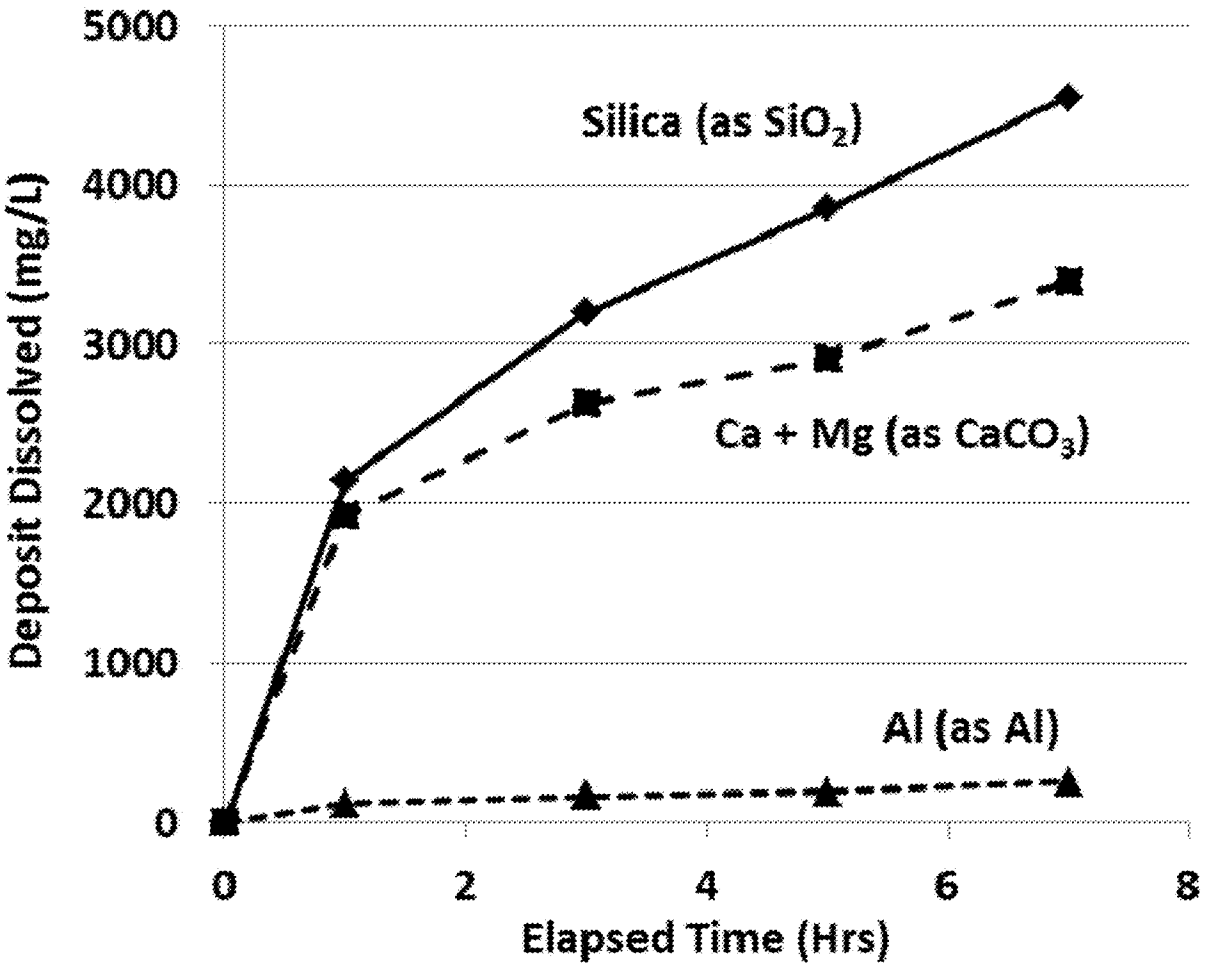
FIG. 7 is a graph of the amount of silica, calcium, and aluminum deposit removed in mg/L versus the elapsed time of the cleaning process with the cleaning composition in hours tested in a laboratory scale experiment described in Example 2.

FIG. 7 demonstrates that the sump deposit dissolution with the cleaning composition shows similar trends as FIG. 6 (distributor cap deposit dissolution).

Example 3

Deposit Dissolution Testing

Due to the different compositions, particle sizes, and surface areas, each of the deposits were ground with a mortar and pestle and then sieved through a #14 sieve so each of the samples would have similar particle size and surface area. Each test solution was prepared by placing 500.00 grams of each solution in a sealable high density polyethylene (HDPE) bottle of known weight. The solution was mixed with a two inch octagon stir bar of known weight on a stirrer hot plate set to a temperature of 55-60° C. and a mix speed of 5.5 for 90 minutes before 5.0 grams of scale deposit was added.

The scale deposit (5.0 g) was added to the preheated test solution and mixed for 16 hours at the same temperature and mix speed. After 16 hours the solution was filtered through filter papers of known weight using the vacuum filtration system. The filter paper and HDPE bottles were dried in the forced air oven until dry. The dry weights of the bottle, stir rod, and filter paper were recorded. The percentage of dissolved material was then calculated as follows:

$$\text{Percentage Deposit Dissolved}=\{[\text{Initial Scale weight}-\text{Total Residue (TRW)}]/\text{Initial Scale Weight}\}*100$$

TABLE 4

Deposit dissolution results

| Cleaning Chemistry | % Dissolved Deposit #1 | % Dissolved Deposit #2 | % Dissolved Deposit #3 | % Dissolved Deposit #4 |
|---|---|---|---|---|
| Nalco-Champion Product No. EC6697A | 80% | 91% | 80% | 69% |
| HF | 78% | 39% | 63% | 51% |
| ABF | 69% | 31% | 56% | 28% |

Example 4

Pilot Scale Boiler Tests

Pilot Scale Boiler (PSB) equipment is used to evaluate efficacy of treatment chemistries and combinations of those treatments. The equipment is also used to evaluate impact of changes in water quality and operating conditions. PSB equipment is designed to provide a rapid indication (within five days) of long-term behavior in larger plant unit operations.

Figure 3:
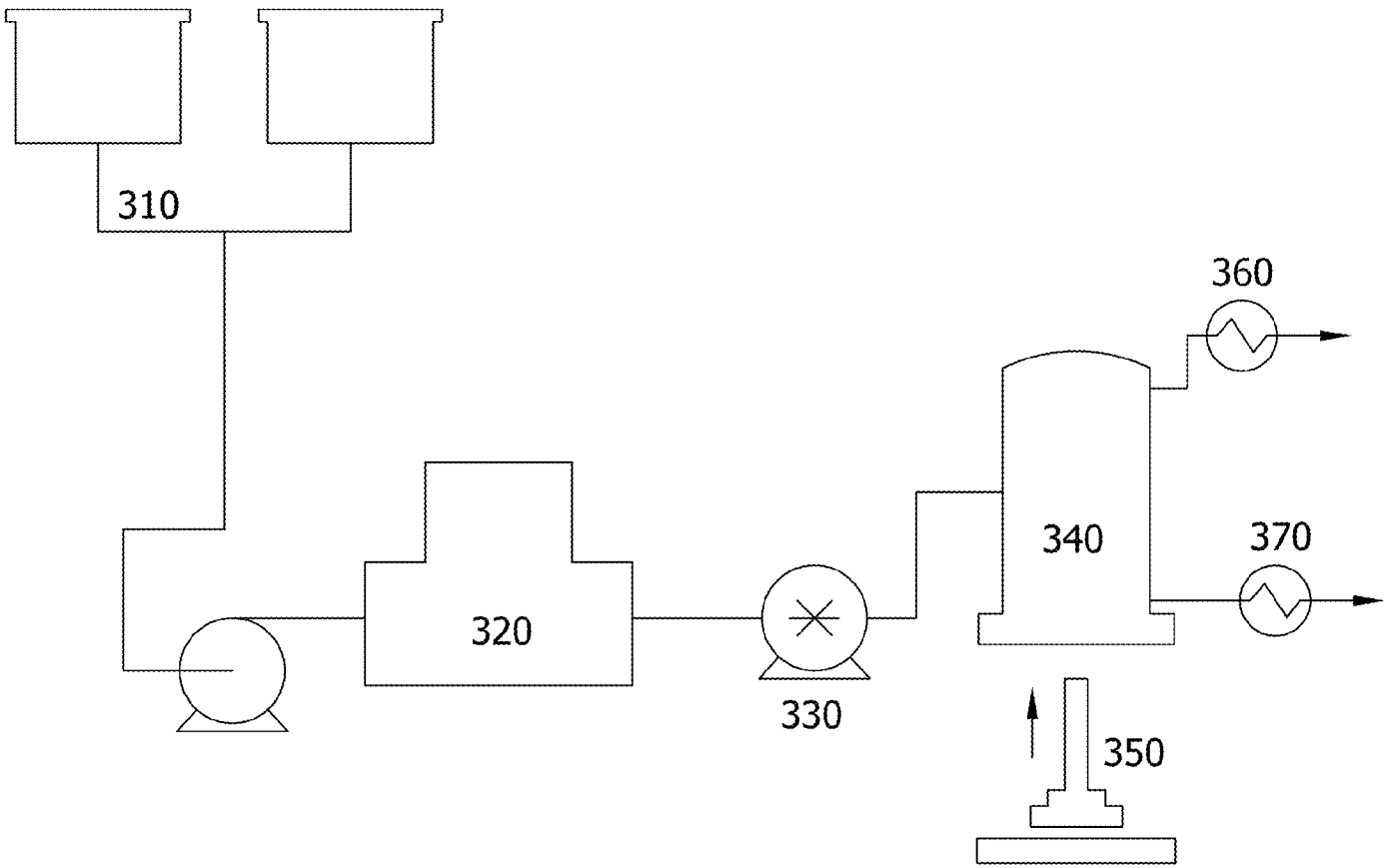
FIG. 3 is a schematic of a pilot scale boiler (PSB) system.

The PSB of FIG. 3 has feedwater fed from feed tanks 310, a pump connecting the feed tanks 310 to the deaerator 320, a boiler feedwater (BFW) pump 330 connecting the deaerator 320 and the boiler 340, a firerod 350 contained in the boiler 340, a condensate exit stream 360 and a blowdown stream 370.

During testing of treatment chemistries and operating conditions, PSB equipment was run under more severe/stressed conditions (water chemistry, heat flux, and residence time) than SAGD plant boilers and steam-generators, in order to reduce the time required to determine results (Table 5).

TABLE 5

Typical comparative operating conditions for PSB test versus OTSG

| Parameter | Pilot Scale Boiler | Location #1 |
|---|---|---|
| Design | Drum | OTSG |
| Energy Source | Electrically-heated fire rod | Natural Gas |
| Steam Pressure | 10,340 kPa (1500 psig) | 9,653 kPa (1400 psig) |
| Steam Temperature | 314° C. (598° F.) | 309° C. (589° F.) |
| Initial Heat Transfer Tube Wall Temperature | up to 344° C. (up to 652° F.) | — |

TABLE 5-continued

Typical comparative operating conditions for PSB test versus OTSG

| Parameter | Pilot Scale Boiler | Location #1 |
|---|---|---|
| Heat Flux | up to 361 kW/m$^2$ (114,000 BTU/ft$^2$/hr) | Refer to footnote* |
| 50% Holding Time (or Residence Time) | ~1.5 hours | <2 minutes (estimate) |
| Concentration Cycles (or Steam Quality | 10 | 5 (80% quality) |

*Typical heat flux range listed in literature is 47-125 kW/m$^2$ or 15,000-40,000 BTU/ft$^2$/hour (Gwak, K.-W., Bae, W. (2010). A Review of Steam Generation for In-Situ Oil Sands Projects. Geosystem Engineering, 13(3), 114.)

Water chemistry used for PSB tests is summarized in Table 6. The tests run at 10 cycles of concentration and the water inside the PSB (measured as blow down) will be 10× more concentrated in all of the feed water chemistries—if no deposition occurs. The feedwater chemistry and PSB cycles of concentration were chosen to provide blowdown water chemistry that is representative of OTSG blowdown water chemistry in Oil Sands applications. Some plants may have higher or lower concentrations of specific chemistries in OTSG blowdown and PSB tests are readily adaptable to test a wide range of water chemistries and operating conditions.

TABLE 6

Pilot scale boiler chemistry (mg/L) (feedwater and 10 × cycles of concentration) vs. OTSG*

| Chemistry of Property | PSB Feedwater × 10 Cycles (mg/L) | Location #1 Feedwater × 4 Cycles* |
|---|---|---|
| Calcium (as Ca) | 1.2 | 1.2 |
| Magnesium (as Mg) | 1.0 | <detection limit |
| Silica (as SiO2) | 300 | 100 |
| Sodium (as Na) | 2,680 | 3,920 |
| Chloride (as Cl) | 3,870 | 4,040 |
| Lithium (as Li) | 6.0 | 4.4 |
| Conductivity (μS) | 13,500 | 17,040 |
| pH | 10.5 | 10.3 |

*Corresponding to 75% steam quality and assumes no deposition occurs (for comparison)

As shown in Table 6, the water quality used for PSB tests at 10 cycles of concentration is generally more severe than SAGD Location #1 operating at 75% steam quality (4 cycles of concentration) and is suitable for doing accelerated testing with equipment such as PSB. Silica volatilization in steam is small (approximately 0.5%) under these operating conditions versus silica concentration in boiler water or blowdown (Nalco (2004), Selective Silica Carryover, Technifax TF-5, 1-3.). Modifications of water and operating conditions listed above can be made when PSB equipment is used to evaluate operating conditions and treatment programs relevant to a variety of SAGD plant locations or other types of boilers (e.g., package or utility).

TABLE 7

Pilot scale boiler performance results for variety of treatment options

| Feedwater Treatment | Thermal Deposition Rate* | Deposit Rate (mg/hr)* |
|---|---|---|
| None | 231 | 3.70 |
| Nalco Product No. 3DT156 | −75 | 3.15 |

TABLE 7-continued

Pilot scale boiler performance results for variety of treatment options

| Feedwater Treatment | Thermal Deposition Rate* | Deposit Rate (mg/hr)* |
|---|---|---|
| Nalco-Champion Product No. EC6697A** | 158 | 1.60 |
| Nalco-Champion Product No. EC6697A** with Nalco Product No. 3DT156 | −190 | 0.42 |

*Lowest values indicate best results

**Concentration of ~30 mg/L as product in feedwater

The overall performance results listed in Table 7 indicate that the lowest combination of thermal deposition rate and deposit rate (mg/hr) were obtained using a treatment combination of cleaning solution (at dosage of ~30 mg/L) and surfactant added to feedwater of PSB

Example 5

Antifoaming Agent Tests

A cleaning composition comprising 15 v/v % Nalco Product No. EC6697A in water was used to evaluate the efficacy of various antifoaming agents. The cleaning composition (10 grams) and the prescribed amount of antifoaming agent were added to each test tube. The height of liquid in each test tube was measured in mm and recorded before shaking Each tube was covered with parafilm, vigorously shaken for one minute, and the height of foam was measured in mm and recorded. The % foam height after one minute of test solution shaking and one minute of test solution sitting was determined by dividing the foam height by the initial liquid height and multiplying by 100. This % foam height was recorded. The test solution was then allowed to sit for 30 minutes and the foam persistence in the test solutions was recorded as yes or no.

The antifoam agents tested were nonionic silicone (available commercially from Nalco, Inc. as Product No. 336FG), an ethoxylated, propoxylated $C_{14}$-$C_{18}$ alcohol (available commercially from Nalco, Inc. as Product No. 00PG-007), nonionic alkoxylated $C_6$-$C_{10}$ alcohol comprising both ethoxy and propoxy groups (available commercially from Nalco, Inc. as Product No. R-50360), nonionic propylene glycol, ethylene glycol block copolymer (available commercially from Nalco, Inc. as Product No. PP10-3038), an ethoxylated $C_{11}$-$C_{14}$ alcohol (available commercially from Nalco, Inc. as Product No. PP10-3148), a propylene oxide glycol polymer (available commercially from Nalco, Inc. as Product No. 7906), a $C_{16}$-$C_{18}$ alcohol (available commercially from Nalco, Inc. as Product No. 7465).

TABLE 8

Percent Foam Height Results*

| Antifoam | 0 mg/L (blank) | 10 mg/L | 100 mg/L | 1,000 mg/L | 10,000 mg/L |
|---|---|---|---|---|---|
| None | 69% | | | | |
| 00PG-007 | | 52% | 3% | 5% | 6% |
| R-50360 | | 65% | 23% | 24% | 6% |
| PP10-3038 | | 56% | 76% | 73% | 15% |
| PP10-3148 | | 55% | 82% | 97% | 97% |
| 7906 | | 52% | 19% | 10% | 0% |
| 336FG | | 56% | 0% | 0% | 0% |
| 7465 | | 65% | 61% | 19% | 13% |

*Lower % is better result

TABLE 9

| Foam Persistence Results* | | | | | |
|---|---|---|---|---|---|
| Antifoam | 0 mg/L (blank) | 10 mg/L | 100 mg/L | 1,000 mg/L | 10,000 mg/L |
| None | Yes | | | | |
| 00PG-007 | | Yes | No | No | No |
| R-50360 | | Yes | Yes | Yes | No |
| PP10-3038 | | Yes | Yes | Yes | Yes |
| PP10-3148 | | Yes | Yes | Yes | Yes |
| 7906 | | Yes | Yes | Yes | No |
| 336FG | | Yes | No | No | No |
| 7465 | | Yes | Yes | Yes | Yes |

*"No" foam persistence is better result

As is shown in Tables 8 and 9, the antifoam agents showing the most advantageous results were a nonionic silicone (available commercially from Nalco, Inc. as Product No. 336FG), an ethoxylated, propoxylated $C_{14}$-$C_{18}$ alcohol (available commercially from Nalco, Inc. as Product No. 00PG-007), nonionic alkoxylated $C_6$-$C_{10}$ alcohol comprising both ethoxy and propoxy groups (available commercially from Nalco, Inc. as Product No. R-50360), and a propylene oxide glycol polymer (available commercially from Nalco, Inc. as Product No. 7906). As can be seen by the results, some of the antifoaming agents were not effective at reducing the foaming of the cleaning solution. In particular, the antifoaming agents of nonionic silicone (available commercially from Nalco, Inc. as Product No. 336FG) and an ethoxylated, propoxylated $C_{14}$-$C_{18}$ alcohol (available commercially from Nalco, Inc. as Product No. 00PG-007) were the most effective of the antifoaming agents tested. The environment of cleaning was one of high acid, high conductivity, a high concentration of cleaning solution and an unusual urea tetrafluoroborate compound, as well as other operating conditions in the evaporator of high temperature and presence of contaminant ions.

Example 6

Field Tests

Based on very positive lab results for dissolution of deposits obtained from plant evaporators, a full-scale cleaning of evaporator was conducted. To start cleaning, the system was taken off-line, drained and flushed with utility water. A known volume of utility water was added to the evaporator, and then concentrated cleaning composition was added to provide an approximately 15% v/v concentration. Since the evaporator was recently taken off-line, the system was still hot at the start of the cleaning process. Some difficulty was initially encountered in keeping the on-line temperature readings of the cleaning solution below the recommended 80° C. limit.

After the initial addition of the cleaning solution, a serious foaming situation was detected inside evaporator based on wide fluctuations in water level measurements. Foaming is a serious problem that must be avoided and quickly remedied when detected because it can cause safety alarms/switches to activate, it can cause cavitation to occur in recirculating pumps, it can limit recirculation of internal fluids, it can result in system vibration, and it can result in fouling of the demister system, which results in contamination of the evaporator distillate and serious consequences to the evaporator system. The foaming that occurred was unexpected and was remedied by addition of an antifoam with similar composition to Nalco 336FG at a dosage rate of approximately 40 mg/L. Foaming within the evaporator system subsided and it was possible to continue with the chemical cleaning process using a 15 v/v % EC6697A cleaning composition.

It was also noted during the cleaning process that the temperature of the cleaning solution tended to increase 2-3° C./hour based on the pumping energy added to the system in order to continuously recirculate the cleaning solution. In order to provide cooling to the system during the cleaning process, additional amounts of utility water and the cleaning composition were added to the system over a 25 hour period. The noticeable decreases in temperature represent periods when significant amount of cool utility water+fresh cleaning composition were added to the existing cleaning solution. Subsequent improvements in cleaning procedure have significantly reduced the need to add more utility water to provide cooling to the system.

Progress of evaporator cleaning process was monitored by analyzing grab samples of cleaning solution from primary and secondary sumps. ICP spectroscopy was used to measure concentrations of aluminum, calcium, magnesium and silica from deposit dissolution. ICP spectroscopy (chromium and iron) was also used to determine if any significant corrosion was occurring on internal surfaces of evaporator system during cleaning. The concentration of cleaning composition was determined by a simple titration procedure and additional treatment added to maintain approximately 15% v/v concentration of cleaner, as needed.

Figure 8:
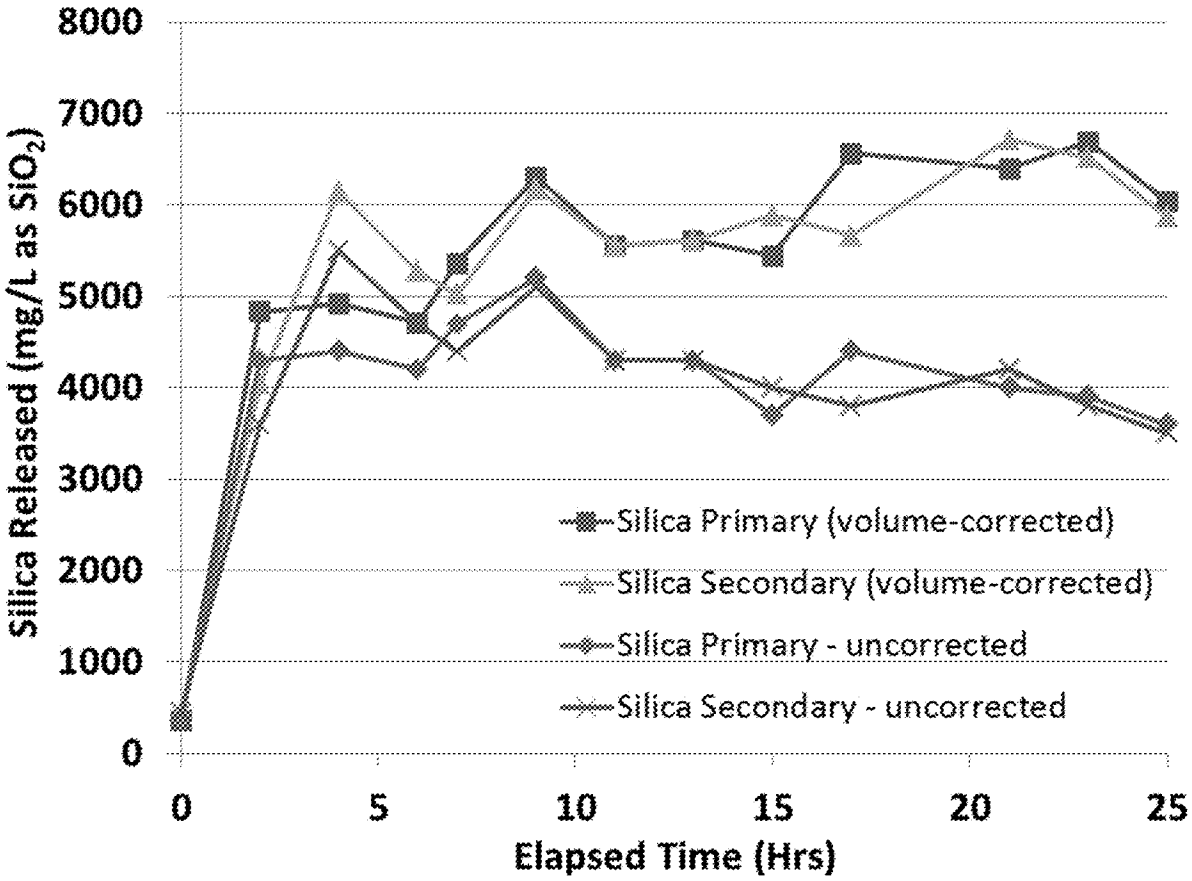
FIG. 8 is a graph of silica concentration (in mg/L) removed versus time using a cleaning composition where the silica concentration is volume corrected and uncorrected for addition of fluid to the system tested in a field experiment described in Example 6.

Because the volume of cleaning solution increased during the cleaning process, ICP spectroscopy results need to be compensated for changes in system volume, which produces dilution in concentrations of species being analyzed. A comparison of ICP spectroscopy readings for silica concentration (uncorrected versus system volume-corrected) from samples of cleaning solution is shown in FIG. 8.

It is clear that correcting ICP spectroscopy readings for changes in system volume during evaporator cleaning is very important in properly interpreting the results. The uncorrected analytical results suggest that cleaning was complete after several hours. Using uncorrected analytical results could have led to decision to terminate cleaning process before it was complete. In reality, removal of silicate-based deposits was occurring during entire 25 hour cleaning period. Although most of the silica from deposits was released during first few hours of cleaning, the more tenacious deposits were likely being removed during 5-25 hours of cleaning. Further, the use of volume-corrected results showed about 70% more dissolution of silica-based deposits, as compared to the uncorrected ICP spectroscopy results. Based on the trends above, system-volume corrected results will be used during rest of the discussion.

Figure 9:
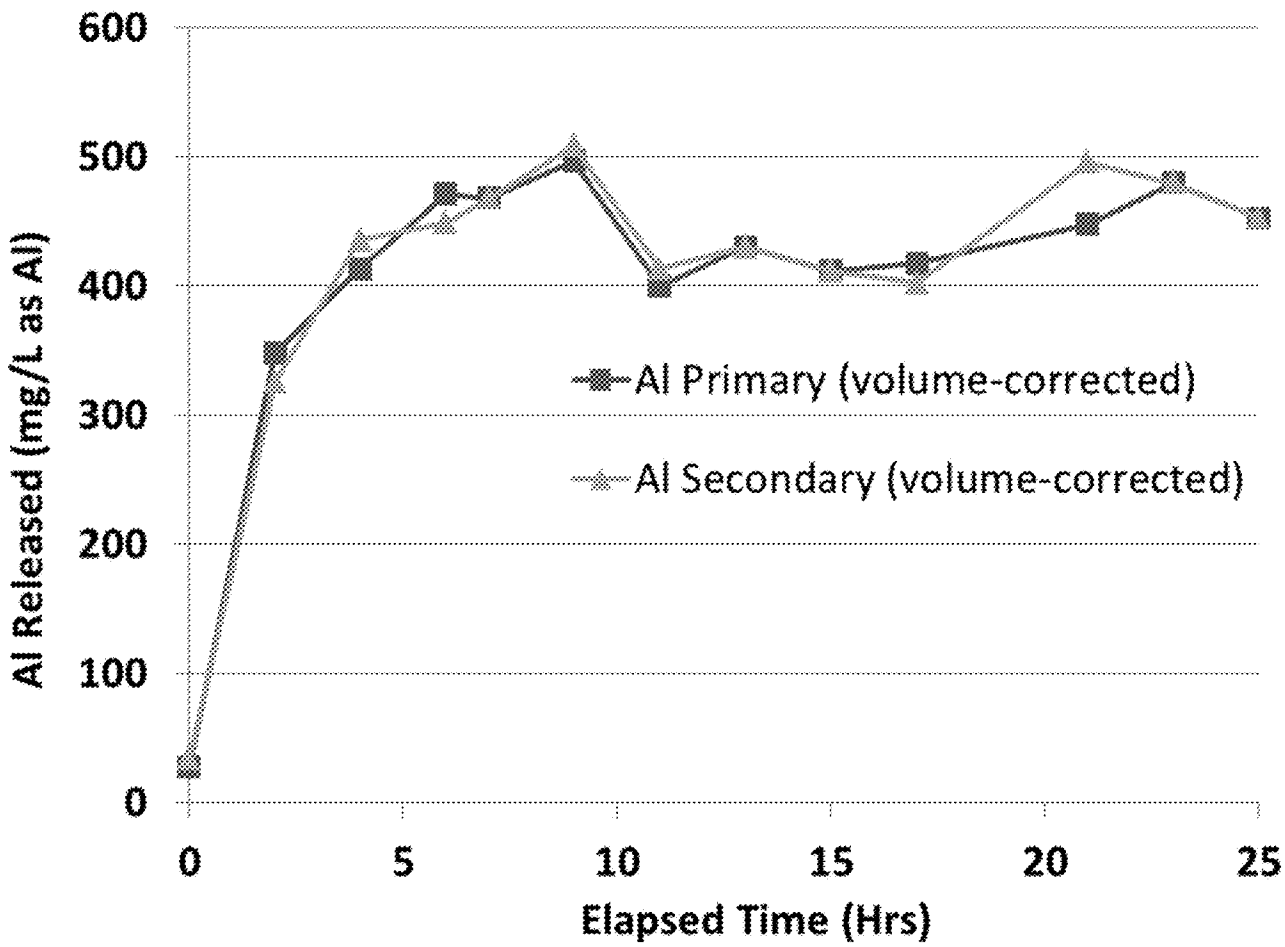
FIG. 9 is a graph of aluminum concentration (in mg/L) removed versus time using a cleaning composition where the aluminum concentration is volume corrected tested in a field experiment described in Example 6.
Figure 10:
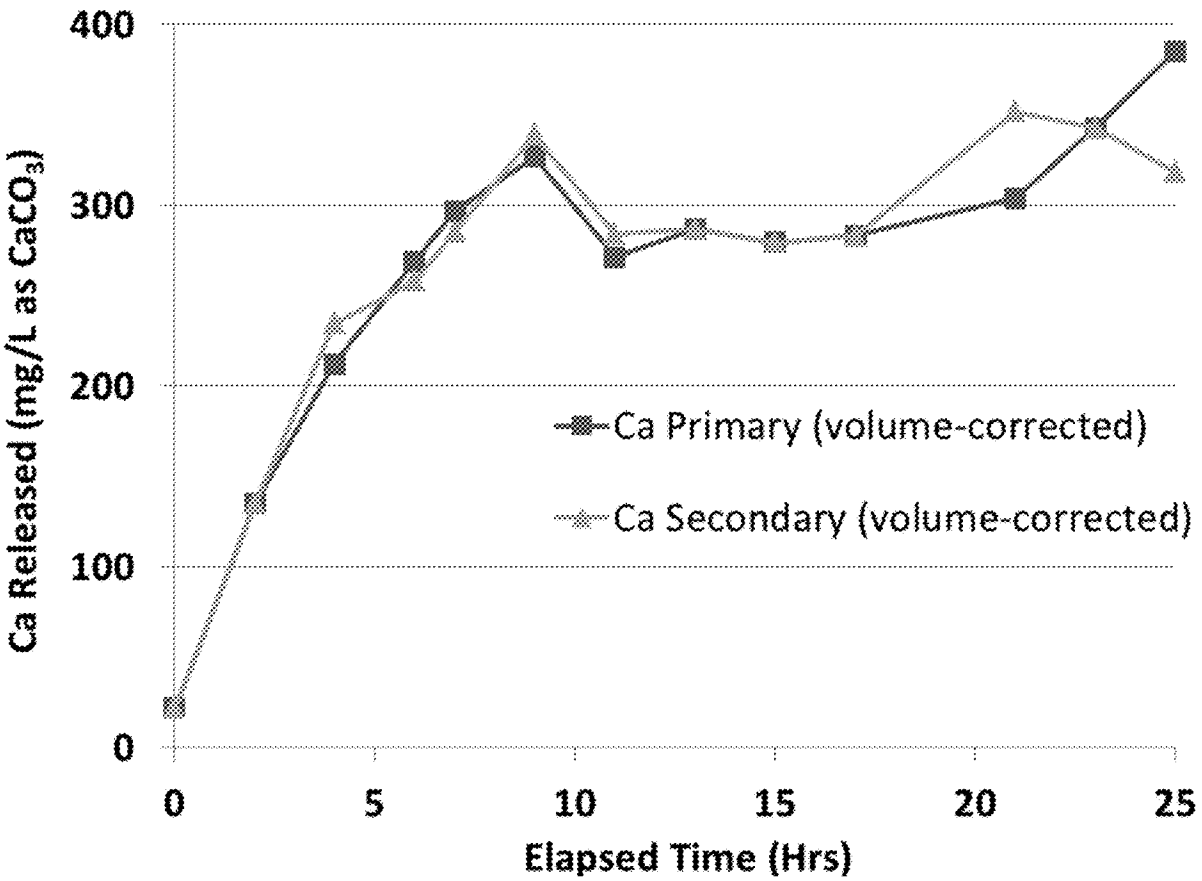
FIG. 10 is a graph of calcium concentration (in mg/L) removed versus time using a cleaning composition where the calcium concentration is volume corrected tested in a field experiment described in Example 6.
Figure 11:
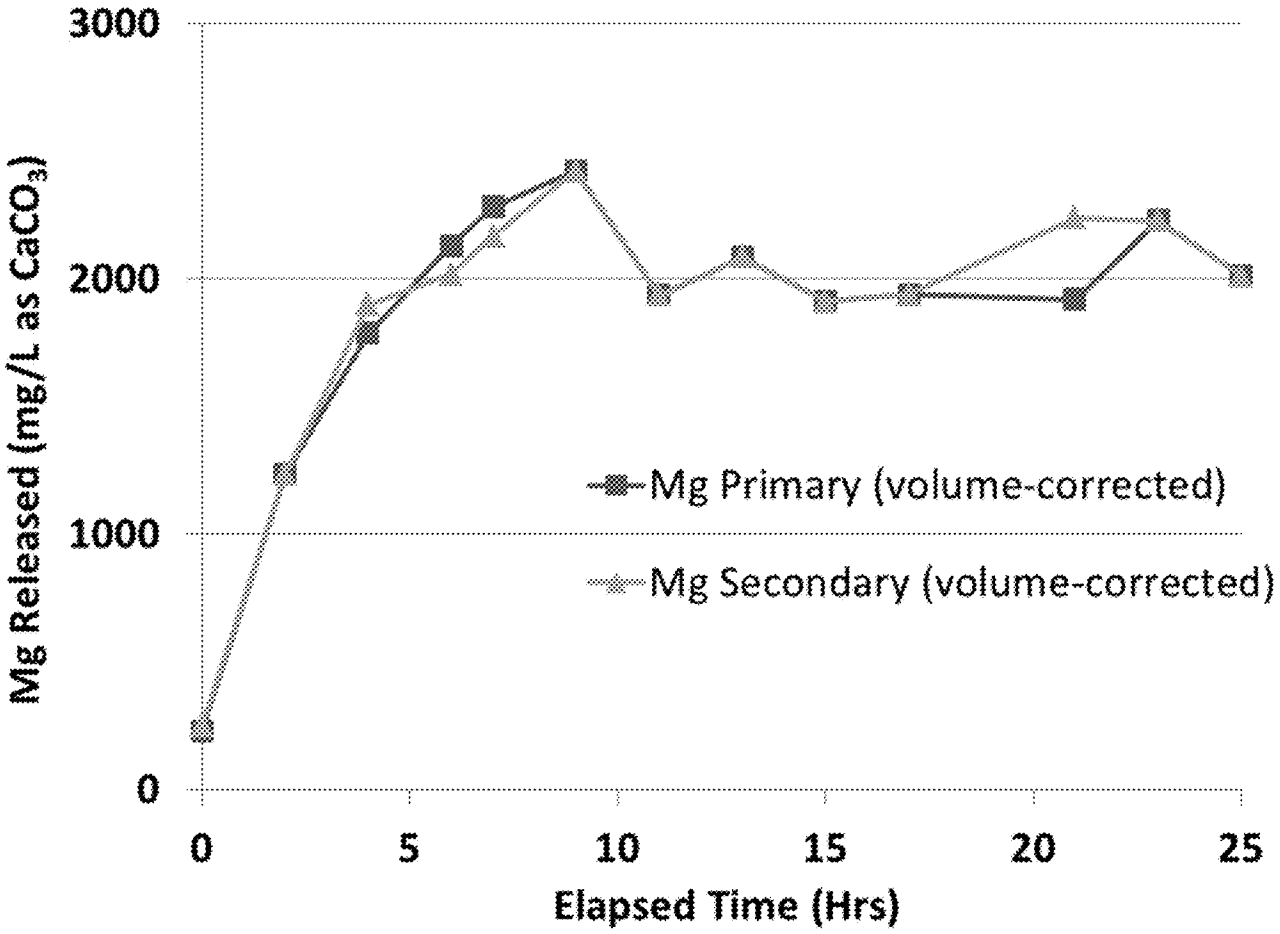
FIG. 11 is a graph of magnesium concentration (in mg/L) removed versus time using a cleaning composition where the magnesium concentration is volume corrected tested in a field experiment described in Example 6.

System-volume corrected ICP spectroscopy results for aluminum, calcium, and magnesium (refer to FIGS. 9-11) gave similar trends as the analytical readings for silica.

The cleaning solution grab samples obtained during the cleaning process were very darkly colored, which indicates high level of organics likely were removed from deposits by the cleaning composition. Dark-colored substances precipitating from cleaning samples over time were collected and measured by C/H/N analyzer. The analytical results showed about 700 mg/L of organics were present, which indicates the cleaning composition is capable of removing inorganic and organic-based deposits.

Figure 12:
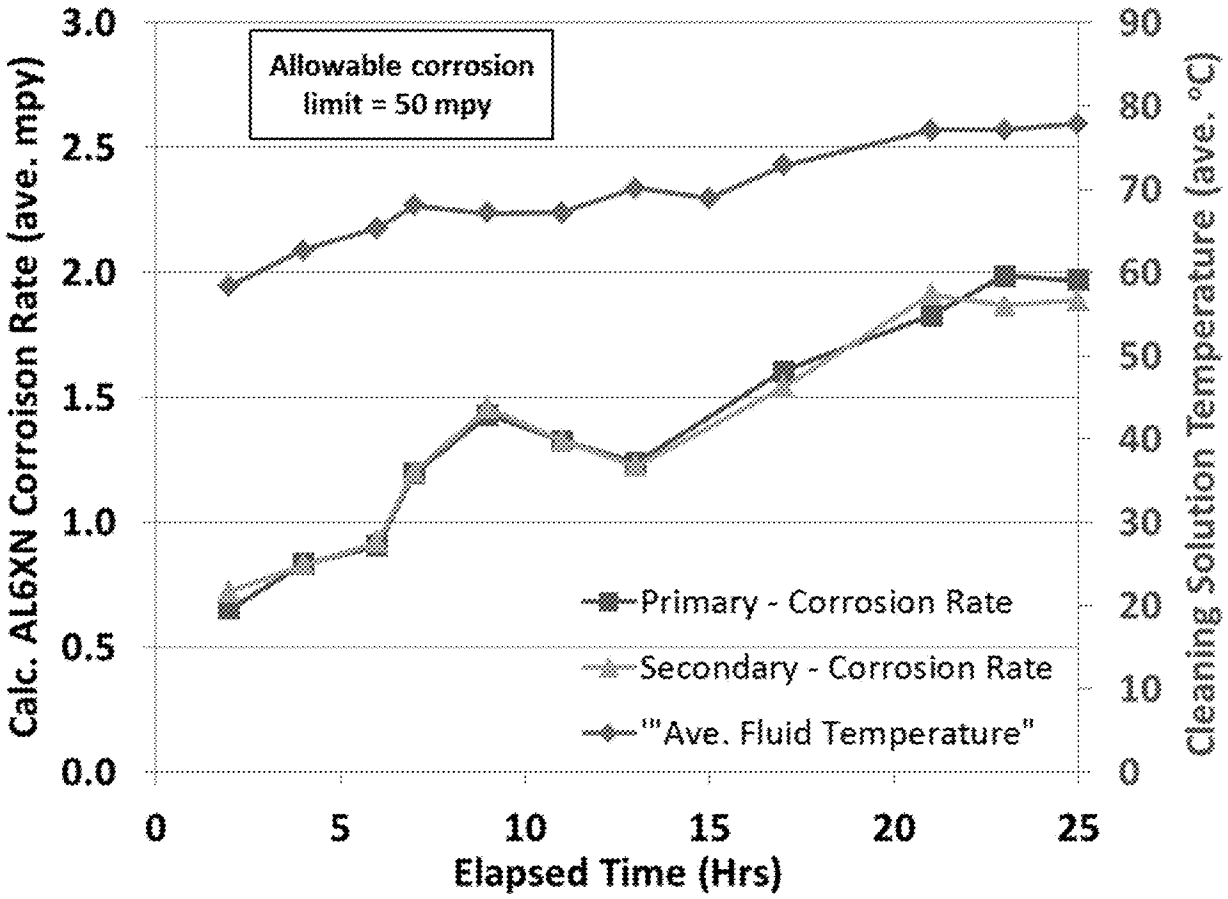
FIG. 12 is a graph of the corrosion rate (in average mpy) versus time using a cleaning composition tested in a field experiment described in Example 6.

In addition to analyzing cleaning solution samples to quantify dissolution of inorganic and organic deposits, those same samples were also measured for chemical evidence of general corrosion on internal surfaces of evaporator. The largest internal surface area of evaporator being cleaned is AL-6XN® which is a superaustenitic stainless steel alloy composed of 23.5-25.5% nickel, 20-22% chromium, 6-7% molybdenum content, trace elements and remainder of approximately 41-51% iron content (Allegheny Technologies Inc., 2014). The evaporator heat-exchanger tube bundles were manufactured from AL-6XN alloy and had a surface area of approximately 12,000 $m^3$. Inductively coupled plasma (ICP) spectroscopy was used to measure chromium and iron concentrations in the cleaning composition samples. Those analyses were combined with information about the evaporator surface area, AL-6XN specific gravity and cleaning solution volume in order to estimate general corrosion rate of AL-6XN. FIG. 12 shows the estimated general corrosion rate of AL-6XN and the temperature of the cleaning solution (average of primary and secondary readings) during the cleaning process.

The estimated corrosion rate (refer to FIG. 12) increases as the temperature of cleaning solution increases, a reasonable response. Maximum general corrosion rate on AL-6XN estimated from cleaning fluid analyses was 1.9 mpy (48 μm/yr), which is well below the allowable limit of 50 mpy (1270 μm/yr) set by the customer. Since use of Cleaning Treatment "A" is typically a 1-2 day process, a negligible increase of ~0.005-0.01 mpy (~0.13-0.26 μm/yr) per cleaning would be added to overall annual corrosion rate of AL-6XN.

The 15 v/v % solution of the cleaning composition was able to remove deposits throughout the evaporator and remove deposits that resisted removal by mechanical cleaning with a high-pressure wash.

Although exceptional results were obtained with the first use of the cleaning composition of the invention, some residual deposits were observed in secondary system of the evaporator during inspection. However, it was noted that any residual deposits after chemical cleaning were much easier to remove by a mechanical cleaning. Further refinements in application of the cleaning composition and multiple cleanings over time of the evaporator system would likely inhibit the formation of tenacious deposits in the wetted portion of the evaporator after chemical cleaning. Inspections of evaporators which used a 15 v/v % solution of the cleaning composition have shown it is possible to clean down to the bare-metal surface throughout the primary and secondary systems.

After utilizing 15 v/v % solution of the cleaning composition to remove evaporator deposits, significant volumes of used cleaning solution (up to 200 $m^3$ or more) may need to be removed before bringing the evaporator back on-line. During initial cleaning of a plant evaporator, used cleaning solution was neutralized with caustic and then removed by trucking off-site for disposal. Disposal of used cleaning solution by utilizing on-site systems is preferred and less costly. Testing was conducted to ensure that used 15 v/v % solution of the cleaning composition would be fully compatible with the downstream disposal water treatment system. Testing was also conducted on the caustic neutralization process of used cleaning solution to ensure that optimal pH for disposal was obtained as quickly as possible without generating excessive heat. After the initial application of 15 v/v % solution of the cleaning composition to the plant evaporator, all subsequent cleanings used the on-site disposal water treatment system for disposal of the used, neutralized cleaning composition. This resulted in an easier cleaning procedure and savings in waste disposal costs.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above compositions and methods without departing from the scope of the invention, it is intended that all matter contained in the above description and shown in the accompanying drawings shall be interpreted as illustrative and not in a limiting sense.

What is claimed is:

1. A method for removing a silica or a silicate deposit or for inhibiting silica or silicate deposition comprising contacting a cleaning composition with an internal surface of a piece of equipment, the surface being in contact with a liquid containing a silica or a silicate and having a silica or a silicate deposit or being susceptible to forming a silica or a silicate deposit, wherein the cleaning composition comprises a nonionic surfactant, an antifoaming agent, and a salt of a nitrogen base having a fluoro inorganic anion, wherein the antifoaming agent comprises a silicone, an ethoxvlated, propoxvlated $C_{14}$-$C_{18}$ alcohol, an ethoxylated, propoxylated $C_6$-$C_{10}$ alcohol, a propylene oxide glycol polymer, or a combination thereof.

2. The method of claim 1 wherein the cleaning composition further comprises an inorganic or organic inhibitor of silica or silicate deposition.

3. The method of claim 1 wherein the cleaning composition further comprises a corrosion inhibitor.

4. The method of claim 1 wherein the piece of equipment is a boiler, steam generator, an evaporator, a heat exchanger, a cooling coil, a tank, a sump, a containment vessel, a pump, a distributor plate, or a tube bundle.

5. The method of claim 1 wherein the piece of equipment is a pipe, a drain line, a fluid transfer line, a production well, or a subterranean hydrocarbon containing reservoir.

6. The method of claim 4 wherein the piece of equipment is an evaporator used in a steam-assisted gravity drainage system.

7. The method of claim 4 wherein the piece of equipment is a steam generator.

8. The method of claim 1 wherein the method removes a silica or silicate deposit and is performed when the piece of equipment is off-line.

9. The method of claim 8 wherein the piece of equipment is an evaporator, a steam generator, or a subterranean formation.

10. The method of claim 1 wherein the method inhibits silica or silicate deposition and is performed when the piece of equipment is on-line.

11. The method of claim 10 wherein the piece of equipment is a boiler or a steam generator.

12. The method of claim 1 wherein the fluoro inorganic anion is tetrafluoroborate, hexafluorophosphate, or a combination thereof.

13. The method of claim 12 wherein the fluoro inorganic anion comprises tetrafluoroborate.

14. The method of claim 12 wherein the nitrogen base is urea, biuret, an alkyl urea, an alkanolamine, an alkylamine, a dialkylamine, a trialkylamine, an alkyldiamine, an alkyltriamine, an alkyltetramine, a polyamine, an acrylamide, a polyacrylamide, a vinyl pyrollidone, a polyvinyl pyrollidone, or a combination thereof.

15. The method of claim 14 wherein the nitrogen base comprises urea.

16. The method of claim 1 wherein the fluoro inorganic anion comprises tetrafluoroborate and the nitrogen base comprises urea and the molar ratio of urea to tetrafluoroboric acid used to prepare the salt is 1:3 to 3:1.

17. A method for removing a silica or a silicate deposit or for inhibiting silica or silicate deposition comprising contacting a cleaning composition with a surface, the surface being in contact with a liquid containing a silica or a silicate and having a silica or a silicate deposit or being susceptible to forming a silica or a silicate deposit, wherein the cleaning composition comprises an antifoaming agent and a salt of a nitrogen base having a fluoro inorganic anion, wherein the antifoaming agent comprises a silicone.

18. The method of claim 1 wherein the cleaning composition further comprises water.

* * * * *